US009945238B2

(12) United States Patent
Hashidate et al.

(10) Patent No.: US 9,945,238 B2
(45) Date of Patent: Apr. 17, 2018

(54) STEAM TURBINE

(71) Applicant: KABUSHIKI KAISHA TOSHIBA, Minato-ku (JP)

(72) Inventors: Tadayuki Hashidate, Sagamihara (JP); Junichi Tominaga, Yokohama (JP); Shinichiro Ohashi, Ota-ku (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 790 days.

(21) Appl. No.: 14/188,828

(22) Filed: Feb. 25, 2014

(65) Prior Publication Data

US 2014/0271140 A1 Sep. 18, 2014

(30) Foreign Application Priority Data

Mar. 12, 2013 (JP) ..... 2013-049321

(51) Int. Cl.
*F01D 25/32* (2006.01)
*F01D 9/04* (2006.01)
*F01D 5/28* (2006.01)

(52) U.S. Cl.
CPC ..... *F01D 9/04* (2013.01); *F01D 5/28* (2013.01); *F01D 9/042* (2013.01); *F01D 25/32* (2013.01);
(Continued)

(58) Field of Classification Search
CPC ..... F01D 5/28; F01D 5/286; F01D 25/32
(Continued)

(56) References Cited

U.S. PATENT DOCUMENTS 1,935,451 A * 11/1933 Jones ..... F01D 25/32 60/677
2007/0014670 A1 1/2007 Maeno
(Continued)

FOREIGN PATENT DOCUMENTS

EP 0 726 384 A1 8/1996
EP 1 744 018 A1 1/2007
(Continued)

OTHER PUBLICATIONS

JPH0861006 English translation.*
(Continued)

*Primary Examiner* — Woody Lee, Jr.
*Assistant Examiner* — Brian O Peters
(74) *Attorney, Agent, or Firm* — Oblon, McClelland, Maier & Neustadt, L.L.P.

(57) ABSTRACT

A steam turbine 10 according to an embodiment includes: a casing 20 having a turbine rotor 22; a diaphragm outer ring 23 arranged at an inner side of the casing 20, and having a hollow part 30 inside thereof; a diaphragm inner ring 24 arranged at an inner side of the diaphragm outer ring 23; and a stationary blade 25 joined to the diaphragm outer ring 23 by welding and supported between the diaphragm outer ring 23 and the diaphragm inner ring 24. A non-joint part 61 existing at a part of a joint part 60 between the diaphragm outer ring 23 and the stationary blade 25, and in which an end part at an outer diameter side of the stationary blade 25 is not welded to the diaphragm outer ring 23; and a suction part 40 collecting waterdroplet or a water film from the non-joint part 61 are included.

18 Claims, 13 Drawing Sheets

(52) U.S. Cl.
CPC .... *F05D 2220/31* (2013.01); *F05D 2230/232* (2013.01)

(58) Field of Classification Search
USPC ..... 415/169.3
See application file for complete search history.

(56) References Cited

U.S. PATENT DOCUMENTS

| | | | | |
|---|---|---|---|---|
| 2008/0050221 | A1* | 2/2008 | Burdgick ..... | F01D 25/32 415/169.2 |
| 2010/0329853 | A1 | 12/2010 | Guo et al. | |

FOREIGN PATENT DOCUMENTS

| | | | |
|---|---|---|---|
| GB | 307762 | * | 12/1929 |
| JP | 53-103002 U | | 8/1978 |
| JP | 08-61006 | | 3/1996 |
| JP | 2004-124751 | | 4/2004 |
| JP | 2007-23895 A | | 2/2007 |

OTHER PUBLICATIONS

Extended Search Report dated Jun. 26, 2014 in European Patent Application No. 14159221.2.
Japanese Office Action dated May 10, 2016 in Patent Application No. 2013-049321 (with unedited computer generated English translation).

* cited by examiner

STEAM TURBINE

CROSS REFERENCE TO RELATED APPLICATION

This application is based upon and claims the benefit of priority from Japanese Patent Application No. 2013-049321, filed on Mar. 12, 2013; the entire contents of which are incorporated herein by reference.

FIELD

Embodiments described herein relate generally to a steam turbine.

BACKGROUND

A steam turbine is used in power generation plants such as a nuclear power generation plant, a thermal power generation plant, a geothermal power generation plant. The steam turbine converts thermal energy of steam from high-pressure to low-pressure into a mechanical work. During this process, a temperature of the steam is lowered at a low-pressure part of the steam turbine, and a part of the steam condenses during an expansion work to increase wetness. The condensed moisture adheres or collides with a wall surface of a steam passage or a rotor blade of the steam turbine.

There is a case when the moisture adhered on the wall surface of the steam passage or the rotor blade grows into waterdroplet whose particle diameter is large. The waterdroplet of large particle diameter moves toward a rotor blade at a subsequent stage (downstream) by a flow of the steam. The waterdroplet of large particle diameter collides with a front edge and so on of the rotor blade at the subsequent stage, and erodes the rotor blade. Besides, the waterdroplet of large particle diameter generates a resistance for a rotation of the rotor blade (so-called a moisture loss). Namely, existence of moisture in the steam passage deteriorates turbine efficiency and reliability of the steam turbine.

Accordingly, in a conventional steam turbine, slits are provided at a stationary blade of a stationary component and a surface of a nozzle diaphragm outer ring of the stationary component supporting the stationary blade, and the moisture adhered on the surface of the stationary component of the steam passage is collected. The stationary component where the slits are provided has a hollow structure. The moisture collected by the slits pass through a hollow part, and is exhausted from the steam passage toward outside of the steam turbine.

The slits at the stationary blade and the surface of the nozzle diaphragm outer ring at the conventional steam turbine are formed to have a width of, for example, 1 mm or less. Accordingly, the slit is generally formed by electric discharge machining. However, there is a case when it is difficult to process the slit by the electric discharge machining because the nozzle diaphragm and so on become thick according to large-sizing of the steam turbine.

DETAILED DESCRIPTION

Hereinafter, embodiments of the present invention are described with reference to the drawings.

First Embodiment

Figure 1:
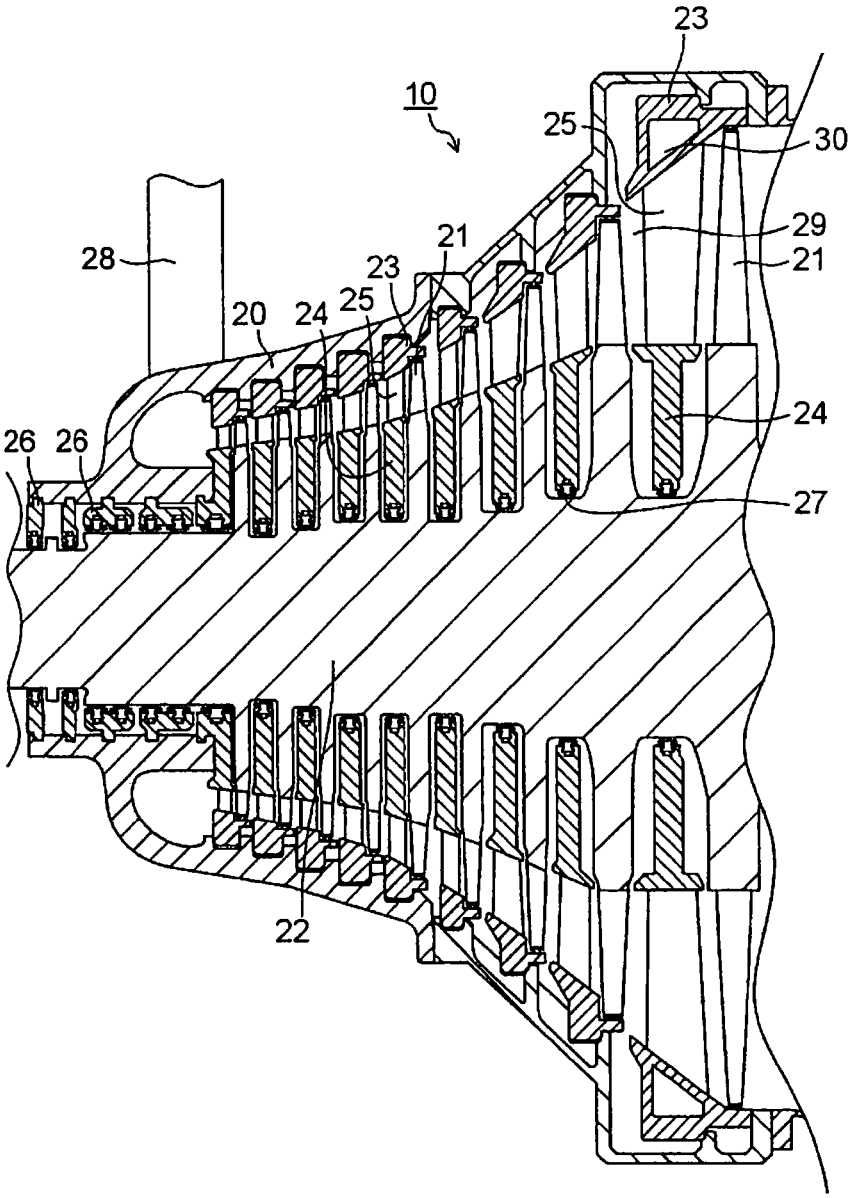
FIG. 1 is a view illustrating a meridian cross section in a vertical direction of a steam turbine according to a first embodiment.

FIG. 1 is a view illustrating a meridian cross section in a vertical direction of a steam turbine 10 according to a first embodiment. As illustrated in FIG. 1, the steam turbine 10 includes a casing 20, and a turbine rotor 22 is provided to penetrate in the casing 20. Plural rotor blades 21 are implanted into the turbine rotor 22 in a circumferential direction to make up a rotor blade cascade. The rotor blade cascades are provided in plural stages in a turbine rotor axial direction. The turbine rotor 22 is rotatably supported by a not-illustrated rotor bearing.

A diaphragm outer ring 23 is arranged at an inner side of the casing 20. A diaphragm inner ring 24 is arranged at an inner side of the diaphragm outer ring 23. Plural stationary blades 25 are supported between the diaphragm outer ring 23 and the diaphragm inner ring 24 in a circumferential direction to make up a stationary blade cascade. The stationary blade cascades are provided in plural stages to be arranged alternately with the rotor blade cascades in the turbine rotor axial direction. One turbine stage is made up of the stationary blade cascade and the rotor blade cascade positioning at an immediately downstream side of the stationary blade cascade.

A gland sealing part 26 is provided between the turbine rotor 22 and the casing 20 so as to prevent leakage of steam toward outside. Besides, a sealing part 27 is provided between the turbine rotor 22 and the diaphragm inner ring 24 so as to prevent leakage of steam.

A steam inlet pipe 28 to introduce the steam toward inside is provided at the steam turbine 10 while penetrating the casing 20. Note that an exhaust flow passage is provided at a downstream side of a final turbine stage to exhaust the steam performing an expansion work at the turbine stage, though it is not illustrated. This exhaust flow passage is communicated with, for example, a condenser (not-illustrated).

Next, a configuration of the turbine stage to be low-pressure and where wet steam flows is described.

Here, the final turbine stage is exemplified to be described as a turbine stage where the wet steam flows. Note that the turbine stage where the wet steam flows is not limited to the final turbine stage, and there is a case when turbine stages at an upstream side than the final turbine stage may be included. A function to secure generated waterdroplet and water film is included in the turbine stage where the wet steam flows.

Figure 2:
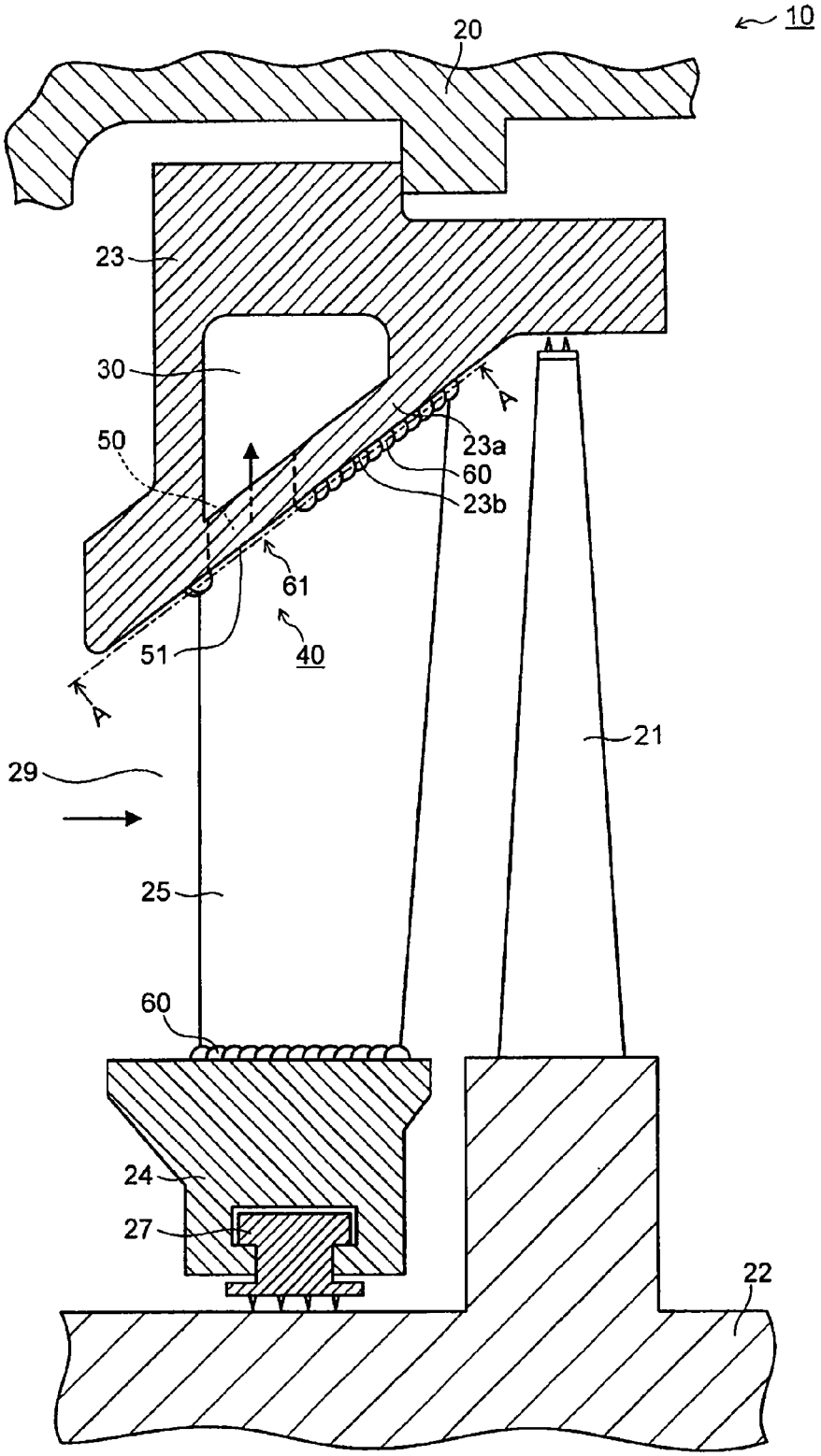
FIG. 2 is a view illustrating a cross section of a part of a final turbine stage in the steam turbine according to the first embodiment.
Figure 3:
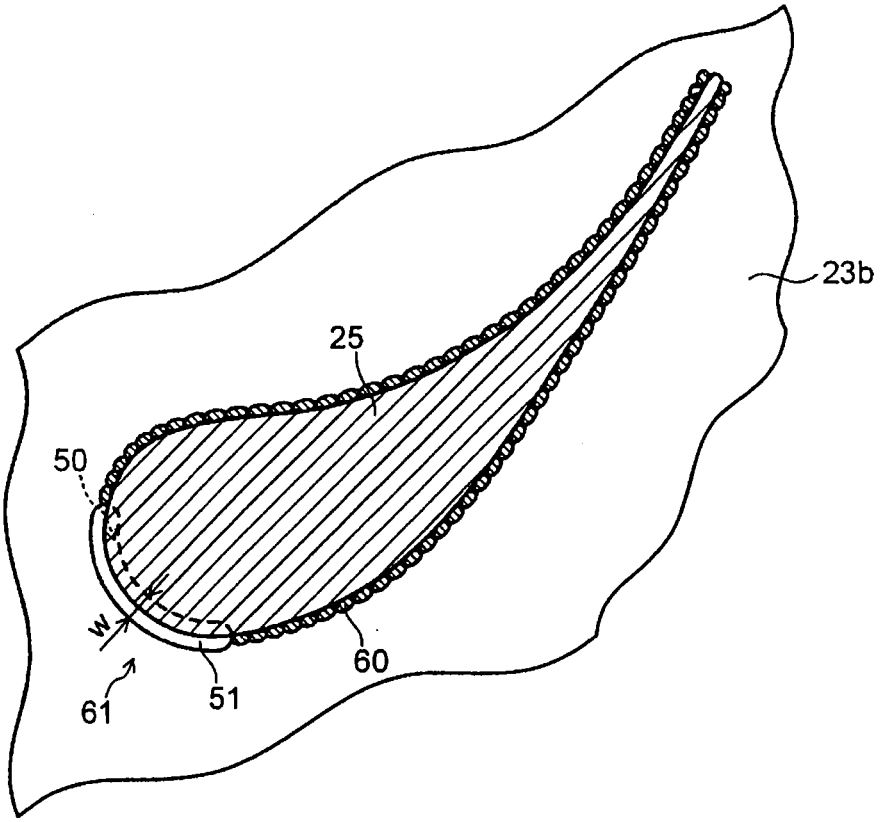
FIG. 3 is a view illustrating an A-A cross section in FIG. 2 where a part of the final turbine stage in the steam turbine according to the first embodiment is illustrated.
Figure 4:
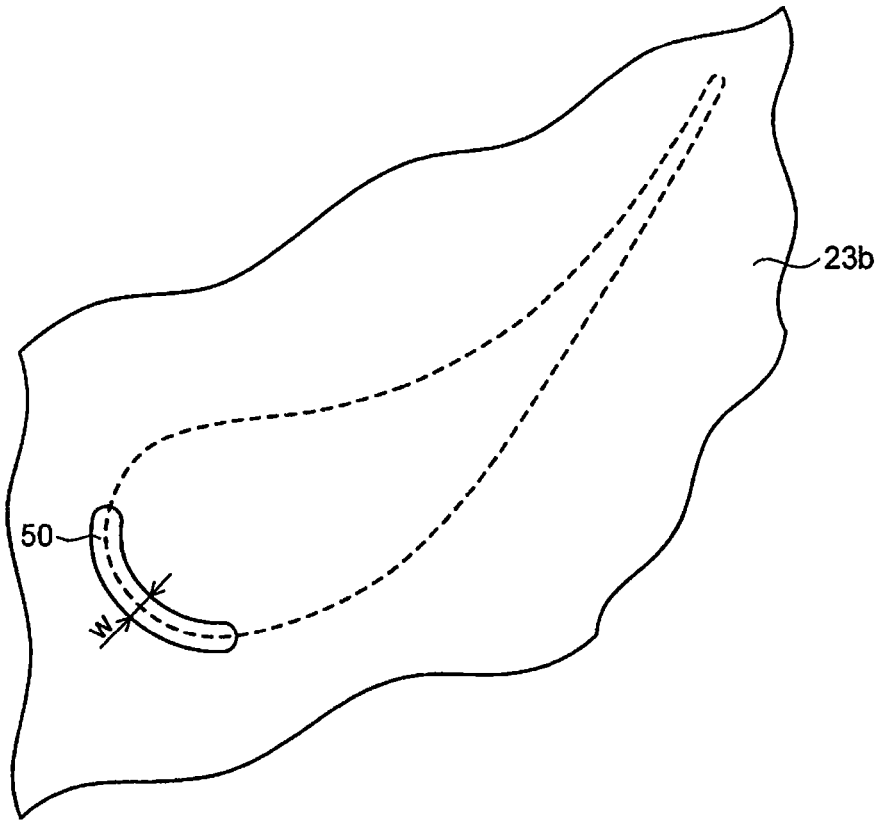
FIG. 4 is a plan view illustrating a through hole formed at a diaphragm outer ring of the final turbine stage in the steam turbine according to the first embodiment.

FIG. 2 is a view illustrating a cross section of a part of the final turbine stage in the steam turbine 10 according to the first embodiment. In FIG. 2, a cross section between the stationary blades 25 is illustrated, and a suction side of the stationary blade 25 is seen. FIG. 3 is a view illustrating an A-A cross section in FIG. 2 in which a part of the final turbine stage in the steam turbine 10 according to the first embodiment is illustrated. FIG. 4 is a plan view illustrating a through hole 50 formed at the diaphragm outer ring 23 at the final turbine stage in the steam turbine 10 according to the first embodiment. Note that a position (a position at an outside contour of the stationary blade 25) where an end part at an outer diameter side (diaphragm outer ring 23 side) of the stationary blade 25 is provided at an inner wall surface of the diaphragm outer ring 23 is represented by a dotted line.

As illustrated in FIG. 2, a suction part 40 collecting the waterdroplet or the water film is formed at a part making up the stationary blade cascade of the final turbine stage. A configuration of the suction part 40 is described. Note that the steam flows from a left side to a right side in FIG. 2.

The diaphragm outer ring 23 has a hollow part 30 at inside thereof as illustrated in FIG. 2. The hollow part 30 is formed in, for example, an annular state in a circumferential direction. The hollow part 30 is communicated with, for example, the condenser (not-illustrated) provided at outside of the steam turbine 10. In this case, the waterdroplet and the water film collected from the suction part 40 to the hollow part 30 are guided to the condenser.

A through hole 50 communicating between a steam flow passage 29 where main steam flows and the hollow part 30 is formed at an inner wall 23*a* of the diaphragm outer ring 23. This through hole 50 has, for example, a predetermined width W and is formed to be along a shape of the end part at the outer diameter side of the stationary blade 25 by which the suction part 40 is made up as illustrated in FIG. 3. Namely, the through hole 50 is formed by a curved through hole having the width W.

The end part at the outer diameter side of the stationary blade 25 is provided to cover a part of the through hole 50 at an inner wall surface 23*b* of the diaphragm outer ring 23 as illustrated in FIG. 3 and FIG. 4. As illustrated in FIG. 3, a part which does not face the through hole 50 of the end part of the stationary blade 25 (a part which does not cover the through hole 50) is joined to the inner wall surface 23*b* of the diaphragm outer ring 23 by welding. The welded part functions as a joint part 60. Besides, the end part at the outer diameter side of the stationary blade 25 covering a part of the through hole 50 is not welded to the inner wall surface 23*b*, and this part functions as a non-joint part 61.

As stated above, the non-joint part 61 exists at a part of the joint part 60, and is formed at a region where, for example, it is easy to collect the waterdroplet or the water film. Specifically, the non-joint part 61 exists at a region from, for example, a front edge to a suction side of the stationary blade 25, a region from the front edge to a pressure side of the stationary blade 25, and so on. Note that an example in which the non-joint part 61 is provided at the region from the front edge to the suction side of the stationary blade 25 is illustrated in FIG. 3.

The part which is not covered with the stationary blade 25 of the through hole 50 at the inner wall surface 23*b* of the diaphragm outer ring 23 opens to the steam flow passage 29. Namely, a part protruding toward outside of an outer edge of the end part of the stationary blade 25 of the through hole 50 of the inner wall surface 23*b* opens to the steam flow passage 29. This opening part functions as a suction port 51 sucking the waterdroplet and the water film flowing in the steam flow passage 29.

An opening area of the suction port 51 can be arbitrary changed by adjusting the width W of the through hole 50 and an area in which the stationary blade 25 covers the through hole 50. It is thereby possible to set the width W of the through hole 50 to be wide compared to a width of a slit (for example, 1 mm or less) sucking the waterdroplet and the water film formed at an inner wall surface of a conventional diaphragm outer ring. It is not particularly limited, but the width W of the through hole 50 can be formed to be approximately, for example, 2 mm to 20 mm. Accordingly, the through hole 50 is easily formed not by the conventional electric discharge machining but by cutting and so on such as, for example, end milling. For example, it is possible to easily process the through hole 50 even when a thickness of the inner wall 23*a* of the diaphragm outer ring 23 increases.

An end part at an inner diameter side (diaphragm inner ring 24 side) of the stationary blade 25 is joined to an outer surface of the diaphragm inner ring 24 by welding. Note that the end part at the inner diameter side of the stationary blade 25 may be fixed by the other methods without being limited to the welding. Besides, the stationary blade 25 may be integrally formed with the diaphragm inner ring 24.

Note that, here, the stationary blade 25 having the solid blade structure is exemplified to be described, but the configuration of the present embodiment can be applied to a stationary blade 25 having either the solid or a hollow blade structure. Besides, for example, a low-pressure turbine can be cited as the steam turbine 10.

Here, operations of the steam turbine 10 are described with reference to FIG. 1 and FIG. 2.

The steam flowing into the steam turbine 10 via the steam inlet pipe 28 passes through the expanding steam flow passage 29 including the stationary blade 25, the rotor blade 21 of each turbine stage while performing the expansion work, to rotate the turbine rotor 22.

A pressure and temperature of the steam are lowered as it goes downstream. For example, the pressure and temperature of the steam are lowered, and the waterdroplet is generated when, for example, wetness expands in nonequilibrium to approximately 3% to 5%. A particle diameter of the waterdroplet increases in accordance with the expansion of the steam at downstream.

At this time, a part of the waterdroplet collides with surfaces of the stationary blade 25 and the rotor blade 21 and adheres thereto. For example, the waterdroplet collides with and adheres to the rotor blade 21 of the turbine stage at an upstream side for one stage than the final turbine stage flows toward an outer peripheral side affected by a force such as a centrifugal force. Therefore, a lot of waterdroplet adheres to the inner wall surface 23*b* of the diaphragm outer ring 23 at the final turbine stage to form the water film.

The water film moves downstream affected by the flow of the steam while adhering on the inner wall surface 23*b*, and is sucked from the suction port 51. The sucked water film passes through the through hole 50 and is collected into the hollow part 30. When the hollow part 30 is communicated with the condenser, the collected water film (water) is guided to the condenser.

Here, when the hollow part 30 is communicated with the condenser (not-illustrated), pressures at the hollow part 30 and the suction part 40 are lower than a pressure at the steam flow passage 29. Accordingly, the water film is sucked from the suction port 51. In addition to the water film, a part of flowing waterdroplet is sucked from the suction port 51.

The steam passing through the final turbine stage passes through the exhaust flow passage (not-illustrated) provided at the downstream of the final turbine stage, and is guided to the condenser (not-illustrated).

As stated above, it is possible to remove the water film and the waterdroplet generated at the steam flow passage 29 of the steam turbine 10 at an upstream side of the rotor blade 21. It is thereby possible to reduce erosion and rotational resistance generated by the waterdroplet collided with the rotor blade 21, and to suppress the deterioration of the turbine efficiency and the reliability.

As stated above, according to the steam turbine 10 of the first embodiment, it is possible to easily form the suction part 40 collecting the waterdroplet and the water film without depending on the electric discharge machining at the turbine stage where the water film and the waterdroplet are generated. For example, even when the thickness of components such as the diaphragm outer ring 23 increases caused by large-sizing of the steam turbine 10, it is possible to easily form the suction part 40 without depending on the electric discharge machining.

Figure 5:
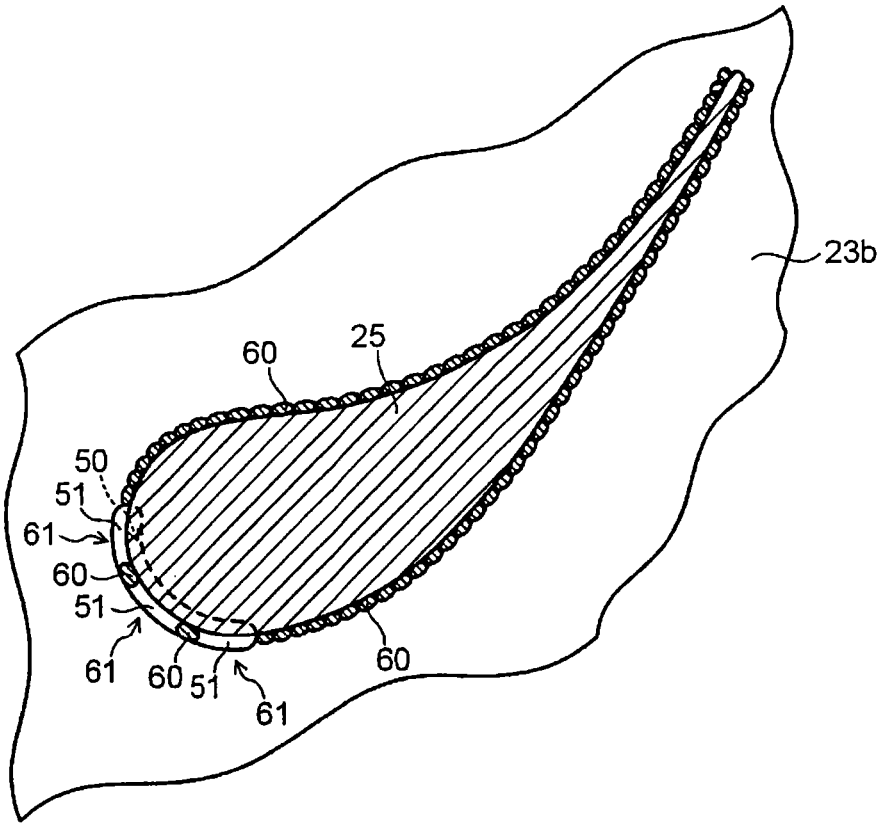
FIG. 5 is a view illustrating a cross section corresponding to the A-A cross section in FIG. 2 illustrating a configuration of another suction port in the steam turbine according to the first embodiment.
Figure 6:
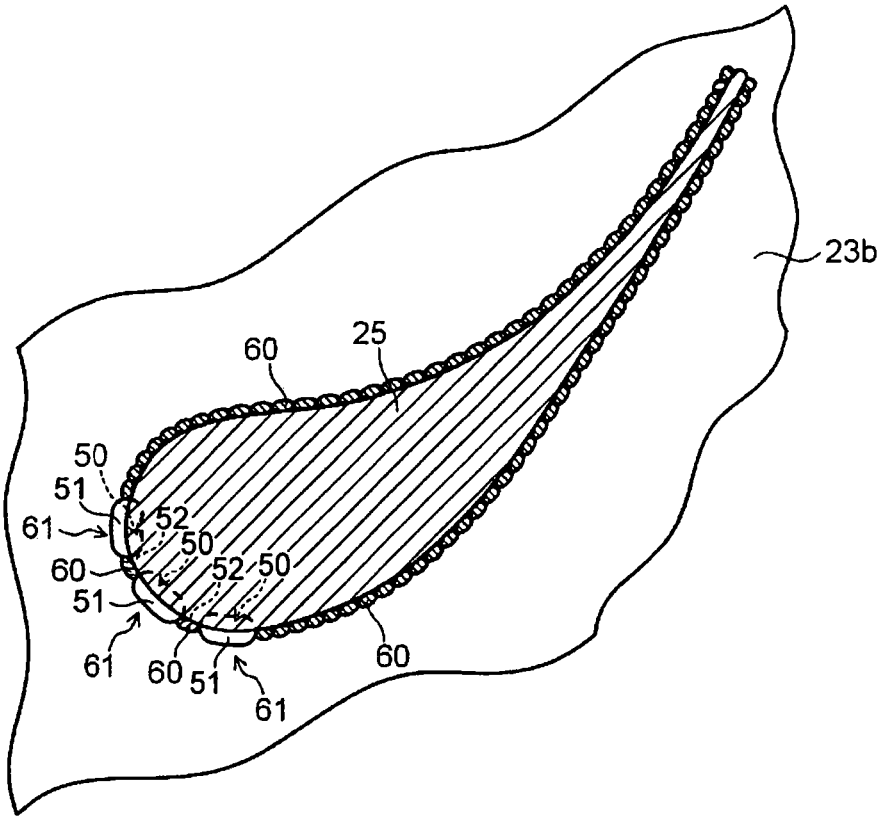
FIG. 6 is a view illustrating a cross section corresponding to the A-A cross section in FIG. 2 illustrating a configuration of still another suction port in the steam turbine according to the first embodiment.

Here, the configuration of the suction port 51 of the suction part 40 is not limited to the above-stated configuration. FIG. 5 and FIG. 6 are views each illustrating a cross section corresponding to the A-A cross section in FIG. 2 illustrating a configuration of another suction port 51 at the steam turbine 10 according to the first embodiment.

As illustrated in FIG. 5 and FIG. 6, the suction port 51 may be made up of plural openings. In FIG. 5, the end part at the outer diameter side of the stationary blade 25 is welded to the inner wall surface 23*b* of the diaphragm outer ring 23 so as to seal two portions of the suction port 51 with a predetermined interval to form joint parts 60.

In FIG. 6, the through hole 50 is divided into plural, and non-through parts 52 are provided between the through holes 50. At the non-through part 52, the end part at the outer diameter side of the stationary blade 25 is welded to the inner wall surface 23*b* of the diaphragm outer ring 23, to form the joint parts 60. It is also possible to easily form the through holes 50 not by the electric discharge machining but by the cutting and so on even when the through hole 50 is divided into plural.

The suction port 51 is made up as stated above, and thereby, it is possible to increase joint strength between the end part at the outer diameter side of the stationary blade 25 and the inner wall surface 23*b* of the diaphragm outer ring 23.

Second Embodiment

Figure 7:
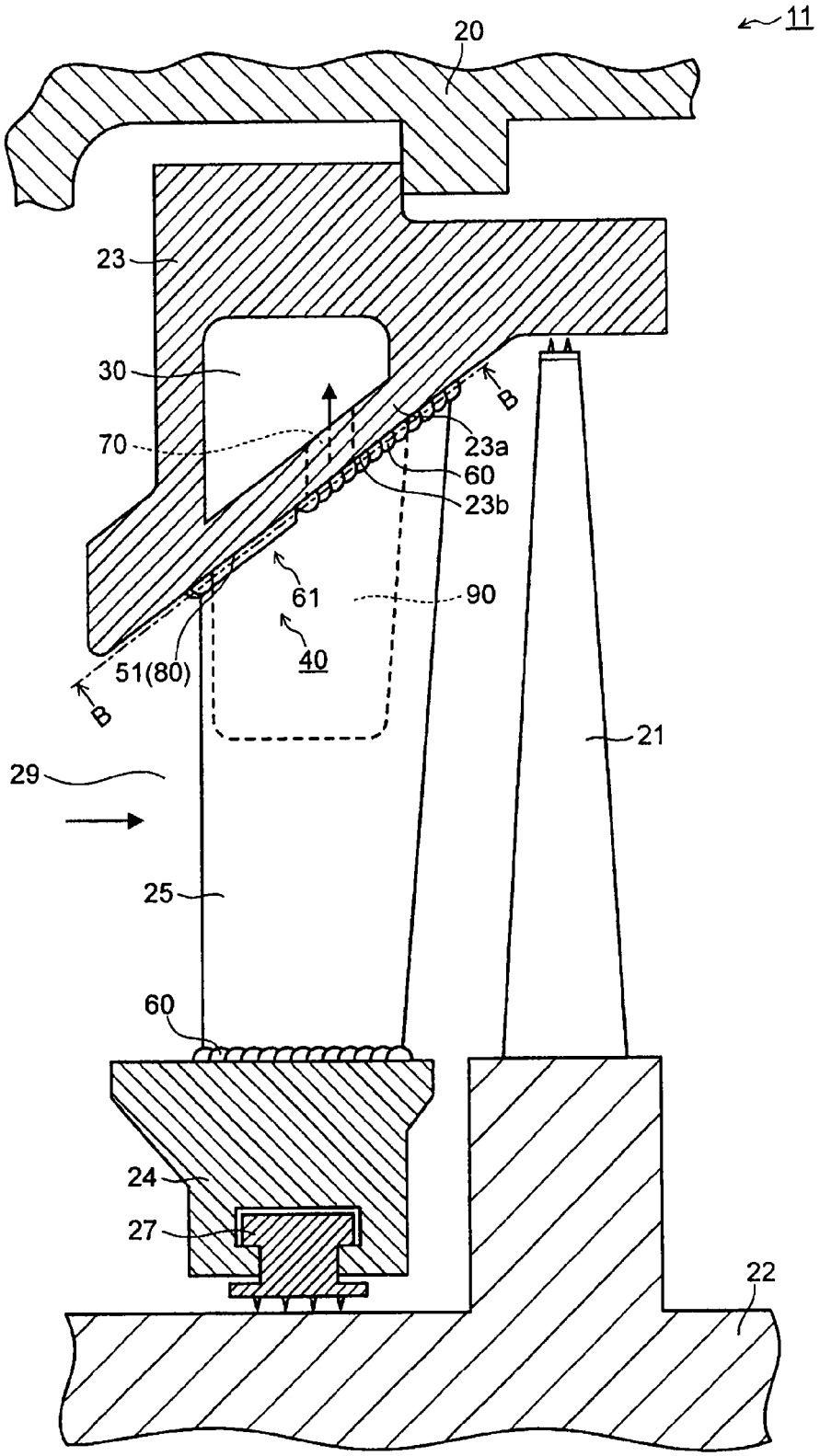
FIG. 7 is a view illustrating a cross section of a part of a final turbine stage in a steam turbine according to a second embodiment.
Figure 8:
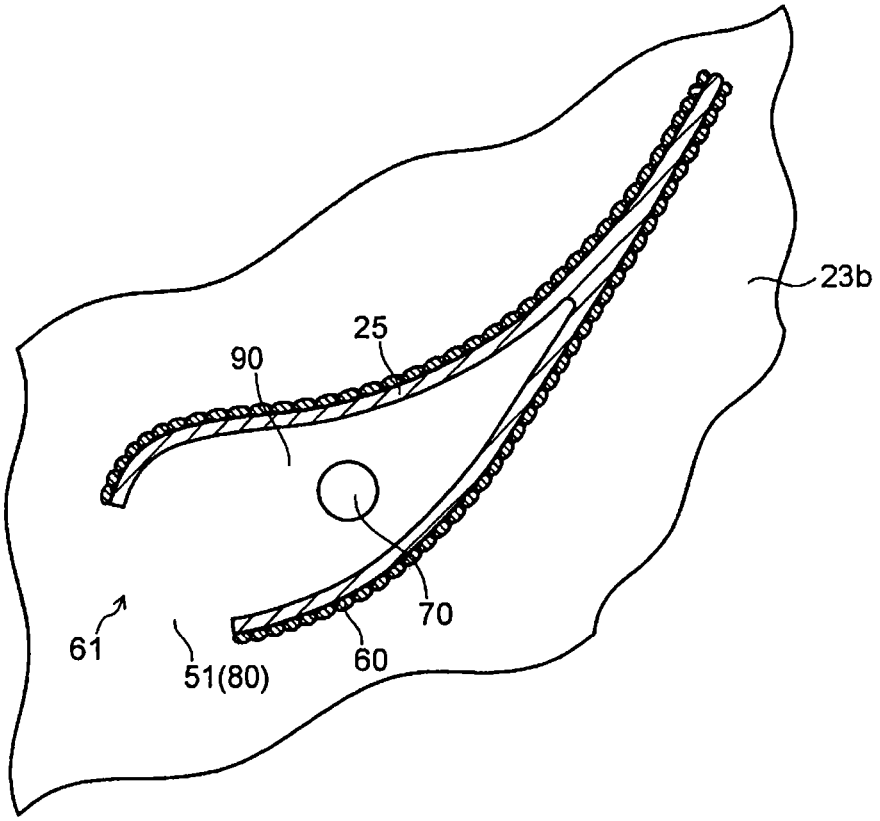
FIG. 8 is a view illustrating a B-B cross section in FIG. 7 illustrating a part of the final turbine stage in the steam turbine according to the second embodiment.

FIG. 7 is a view illustrating a cross section of a part of a final turbine stage in a steam turbine 11 according to a second embodiment. In FIG. 7, a cross section between the stationary blades 25 is illustrated, and a suction side of the stationary blade 25 is seen. FIG. 8 is a view illustrating a B-B cross section in FIG. 7 where a part of the final turbine stage in the steam turbine 11 according to the second embodiment is illustrated. Note that the same reference numerals are used for the same components as the steam turbine 10 according to the first embodiment, and redundant description is not given or is simplified.

In the steam turbine 11 according to the second embodiment, other than a configuration of the suction part 40 is the same as the configuration of the steam turbine 10 according to the first embodiment. Accordingly, here, the configuration of the suction part 40 is mainly described.

As illustrated in FIG. 7, the suction part 40 collecting the waterdroplet or the water film is formed at a part where the stationary blade cascade of the final turbine stage is formed. Note that the steam flows from a left side to a right side in FIG. 7.

The diaphragm outer ring 23 has the hollow part 30 at inside thereof as illustrated in FIG. 7. The hollow part 30 is communicated with, for example, the condenser (not-illustrated) provided at outside of the steam turbine 11.

A through hole 70 penetrating from the inner wall surface 23*b* to the hollow part 30 is formed at the inner wall 23*a* of the diaphragm outer ring 23. This through hole 70 is formed at the inner wall 23*a* of the diaphragm outer ring 23 at a part where the inner wall surface 23*b* is covered with the stationary blade 25 when the stationary blade 25 is joined as illustrated in FIG. 8. Namely, the through hole 70 is formed at a part of the inner wall 23*a* facing the stationary blade 25. A cross-sectional shape of the through hole 70 is not particularly limited, and for example, it is formed in circle as illustrated in FIG. 8.

A recessed groove 80 is formed at an end face at the outer diameter side of the stationary blade 25 as illustrated in FIG. 7. This recessed groove 80 makes up the suction port 51 sucking the waterdroplet and the water film when the end part at the outer diameter side of the stationary blade 25 is welded to the inner wall surface 23*b* of the diaphragm outer ring 23. Namely, the suction port 51 is formed at a part surrounded by an inner wall surface of the recessed groove 80 and the inner wall surface 23*b* of the diaphragm outer ring 23. The recessed groove 80 is formed at a region where it is easy to collect the waterdroplet or the water film such as, for example, a region from a front edge to a suction side of the stationary blade 25, and a region from the front edge to a pressure side of the stationary blade 25.

Here, a stationary blade having a hollow part 90 at inside at the outer diameter side of the stationary blade 25 is exemplified as the stationary blade 25. This hollow part 90 is communicated with the hollow part 30 via the through hole 70.

The stationary blade 25 is disposed to cover the through hole 70 as illustrated in FIG. 8, and a part other than the recessed groove 80 of the end part of the stationary blade 25 is joined to the inner wall surface 23*b* of the diaphragm outer ring 23 by welding. The part where the welding is performed functions as the joint part 60, and a part which is not welded and where the recessed groove 80 is formed functions as the non-joint part 61.

The suction port 51 is communicated with the hollow part 30 via the hollow part 90 and the through hole 70. An opening area of the suction port 51 can be arbitrary changed by adjusting a groove depth and a groove width of the recessed groove 80. The recessed groove 80 is formed at the end face at the outer diameter side of the stationary blade 25, and therefore, it is easily formed by, for example, grinding, cutting, and so on. Besides, the recessed groove 80 may be formed together with the stationary blade in itself at casting time of the stationary blade 25 without depending on the grinding, the cutting, and so on. It is possible to easily form the recessed groove 80 by the formation methods of the recessed groove 80 as stated above even when, for example, the thickness of the stationary blade 25 increases.

Also in the steam turbine 11 according to the second embodiment, for example, the water film adhered to the inner wall surface 23*b* of the diaphragm outer ring 23 at the final turbine stage moves downward affected by the flow of the steam while being adhered to the inner wall surface 23*b* and is sucked from the suction port 51 as same as the steam turbine 10 according to the first embodiment. The sucked water film passes through the through hole 70 and is collected into the hollow par 30. When the hollow part 30 is communicated with the condenser (not-illustrated), the collected water film (water) is guided to the condenser.

As stated above, it is possible to remove the water film and the waterdroplet generated at the steam flow passage 29 of the steam turbine 11 at an upstream side of the rotor blade 21. It is thereby possible to reduce the erosion and the rotational resistance generated by the waterdroplet colliding with the rotor blade 21 and to suppress deterioration of the turbine efficiency and the reliability.

As stated above, according to the steam turbine 11 of the second embodiment, it is possible to easily form the suction part 40 collecting the waterdroplet and the water film at the turbine stage where the water film and the waterdroplet are generated. For example, it is possible to easily form the suction part 40 even when the thickness of the component such as the diaphragm outer ring 23 increases caused by the large-sizing of the steam turbine 11.

Note that, here, the stationary blade 25 having the hollow blade structure is exemplified to be described, but the present embodiment can be applied to the stationary blade 25 having the solid blade structure.

Figure 9:
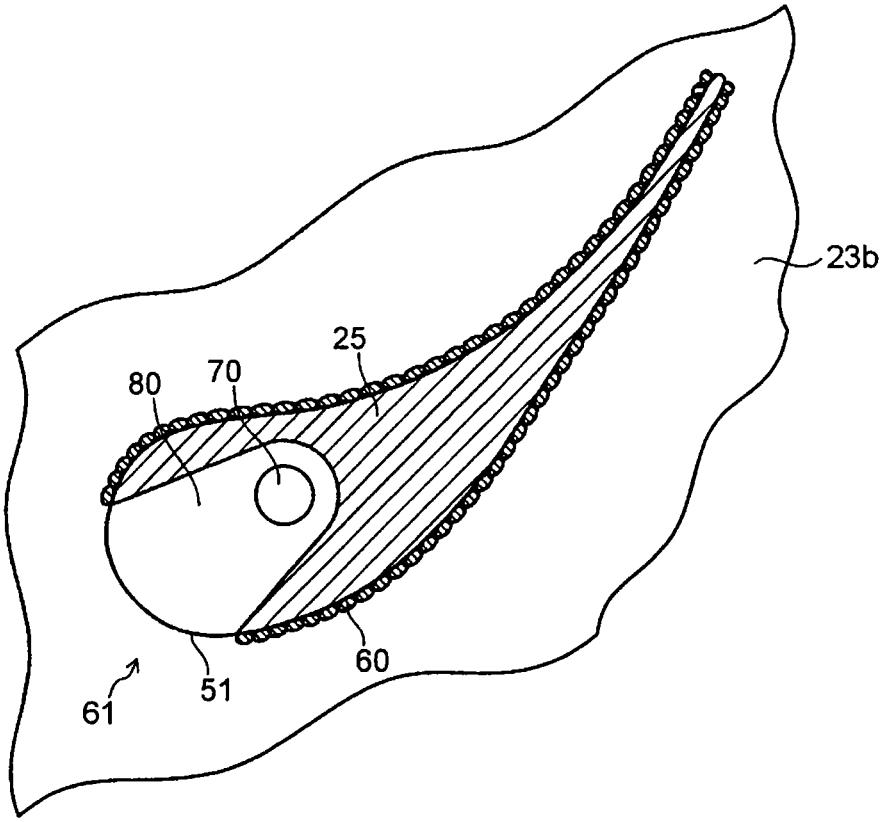
FIG. 9 is a view illustrating the B-B cross section in FIG. 7 when a stationary blade having a solid blade structure is used for the stationary blade at the final turbine stage in the steam turbine according to the second embodiment.

FIG. 9 is a view illustrating the B-B cross section in FIG. 7 when the stationary blade having the solid blade structure is used for the stationary blade 25 at the final turbine stage in the steam turbine 11 according to the second embodiment.

In this case, the through hole 70 is formed at a position communicating with the recessed groove 80 formed at the end face at the outer diameter side of the stationary blade 25 as illustrated in FIG. 9. In other words, the recessed groove 80 is formed at the end face at the outer diameter side of the stationary blade 25 up to the position communicating with the through hole 70. The suction port 51 is communicated with the hollow part 30 via the recessed groove 80 and the through hole 70.

Figure 10:
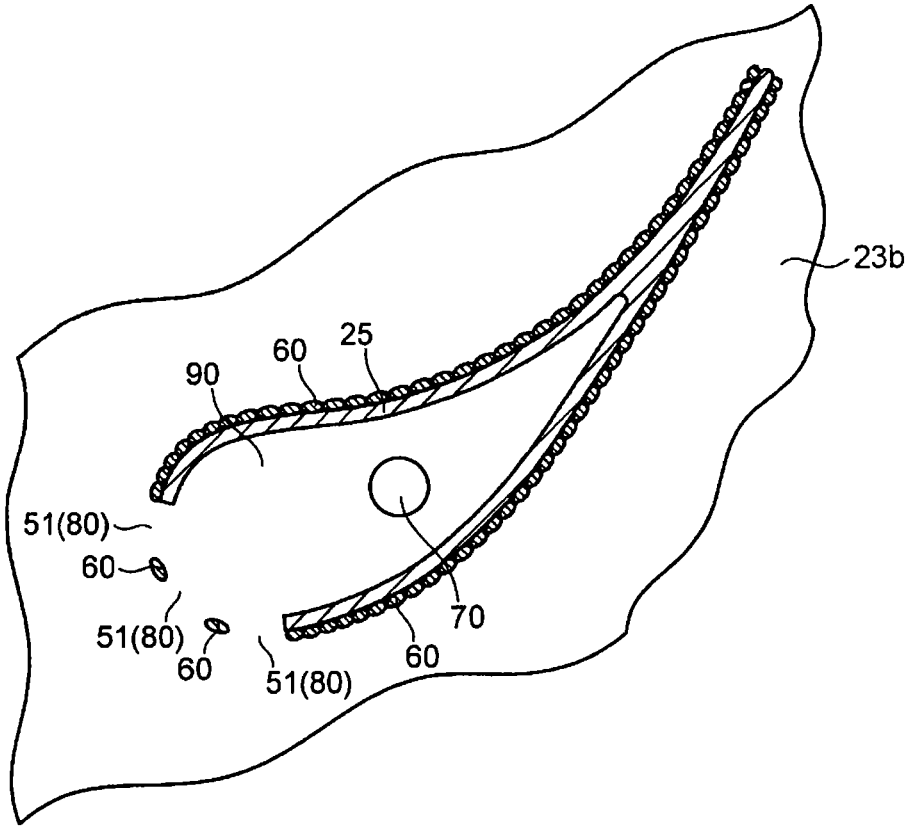
FIG. 10 is a view illustrating a cross section corresponding to the B-B cross section in FIG. 7 illustrating a configuration of another suction port in the steam turbine according to the second embodiment.
Figure 11:
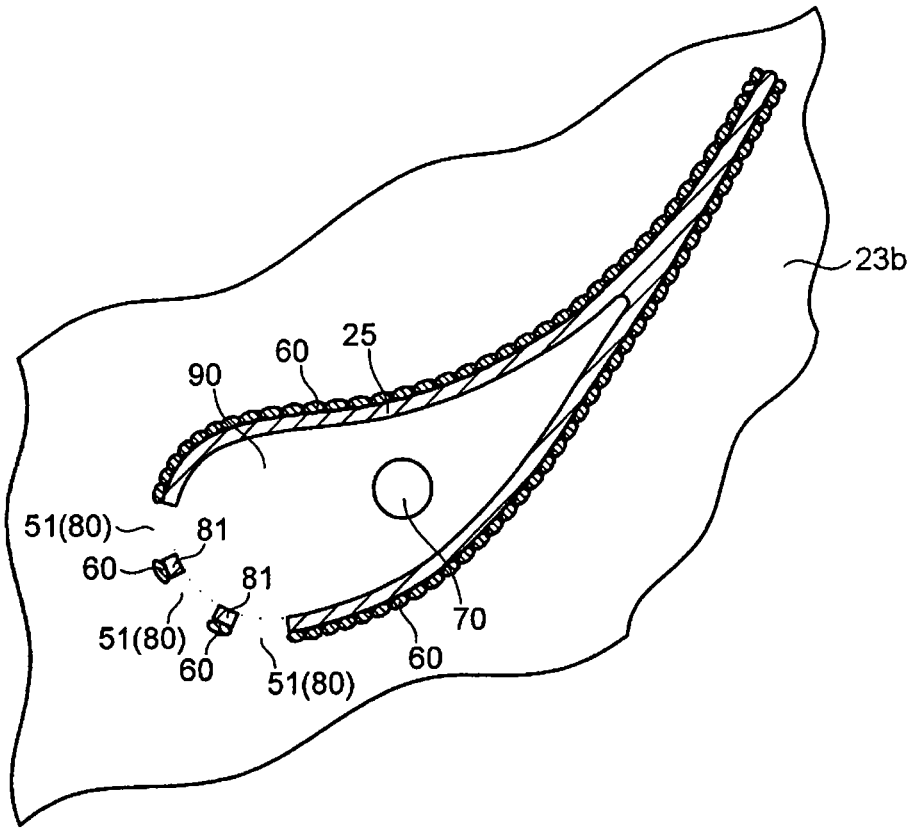
FIG. 11 is a view illustrating the cross section corresponding to the B-B cross section in FIG. 7 illustrating a configuration of still another suction port in the steam turbine according to the second embodiment.

Besides, a configuration of the suction port 51 of the suction part 40 is not limited to the above-stated configuration. FIG. 10 and FIG. 11 are views each illustrating a cross section corresponding to the B-B cross section in FIG. 7 illustrating the configuration of another suction port 51 in the steam turbine 11 according to the second embodiment. Note that, here, the stationary blade 25 having the hollow blade structure is exemplified to be described.

As illustrated in FIG. 10 and FIG. 11, the suction port 51 may be made up by plural openings. In FIG. 10, the joint parts 60 are formed by welding between a bottom part of the recessed groove 80 and the inner wall surface 23*b* of the diaphragm outer ring 23 so that two portions of the suction port 51 are sealed with a predetermined interval.

In FIG. 11, the recessed groove 80 is divided into plural, and non-groove parts 81 where the recessed grooves 80 are not formed are provided between the recessed grooves 80. At each of the non-groove parts 81, the end part at the outer diameter side of the stationary blade 25 is welded to the inner wall surface 23*b* of the diaphragm outer ring 23 to form the joint part 60. It is possible to easily form the divided recessed grooves 80 by a method similar to the above-stated method forming the recessed groove 80 even in a case when the recessed groove 80 is divided into plural.

The suction port 51 is made up as stated above, and thereby, it is possible to increase the joint strength between the end part at the outer diameter side of the stationary blade 25 and the inner wall surface 23*b* of the diaphragm outer ring 23.

Third Embodiment

Figure 12:
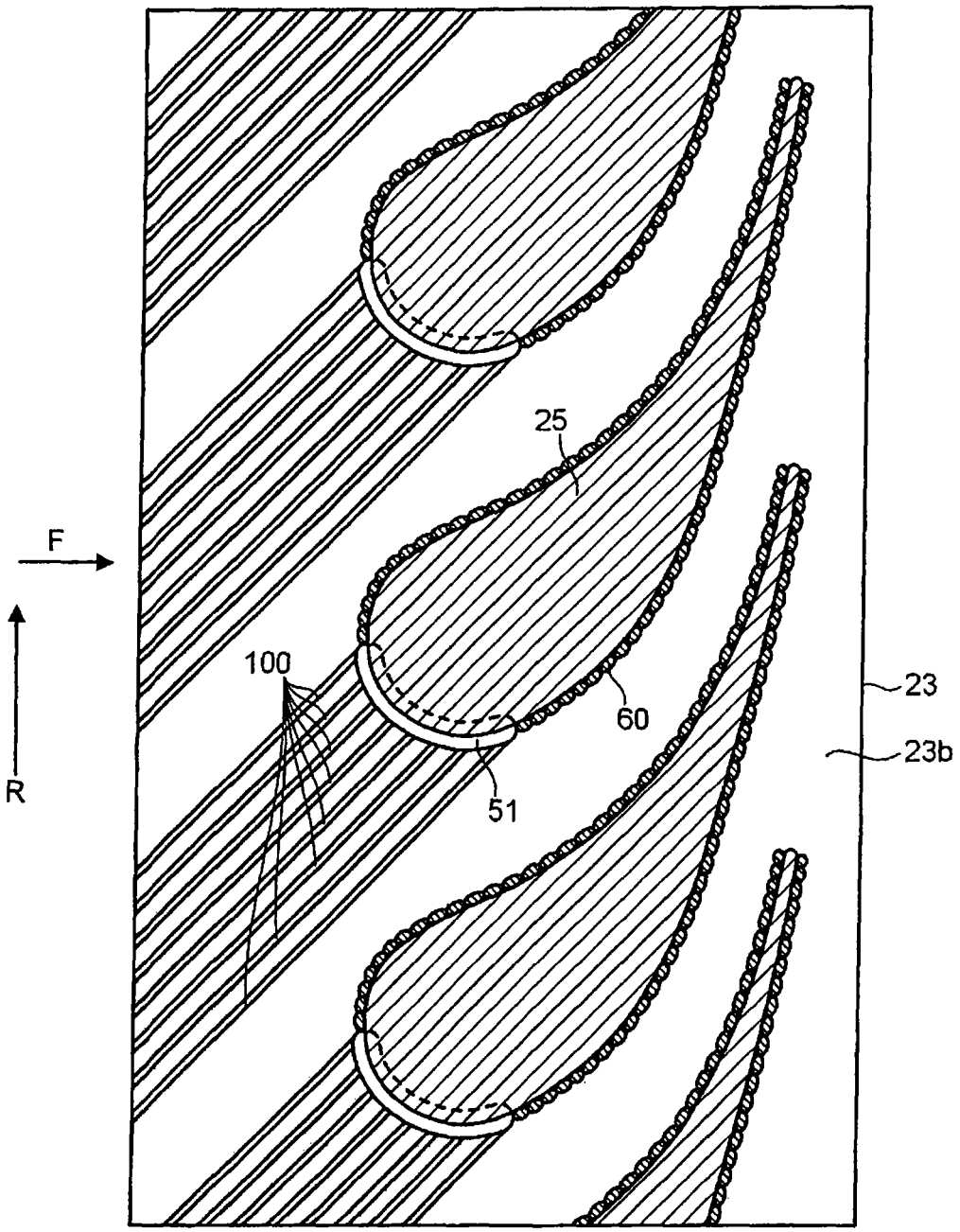
FIG. 12 is a view illustrating a cross section corresponding to the A-A cross section in FIG. 2 where a part of a final turbine stage in a steam turbine according to a third embodiment is illustrated.
Figure 13:
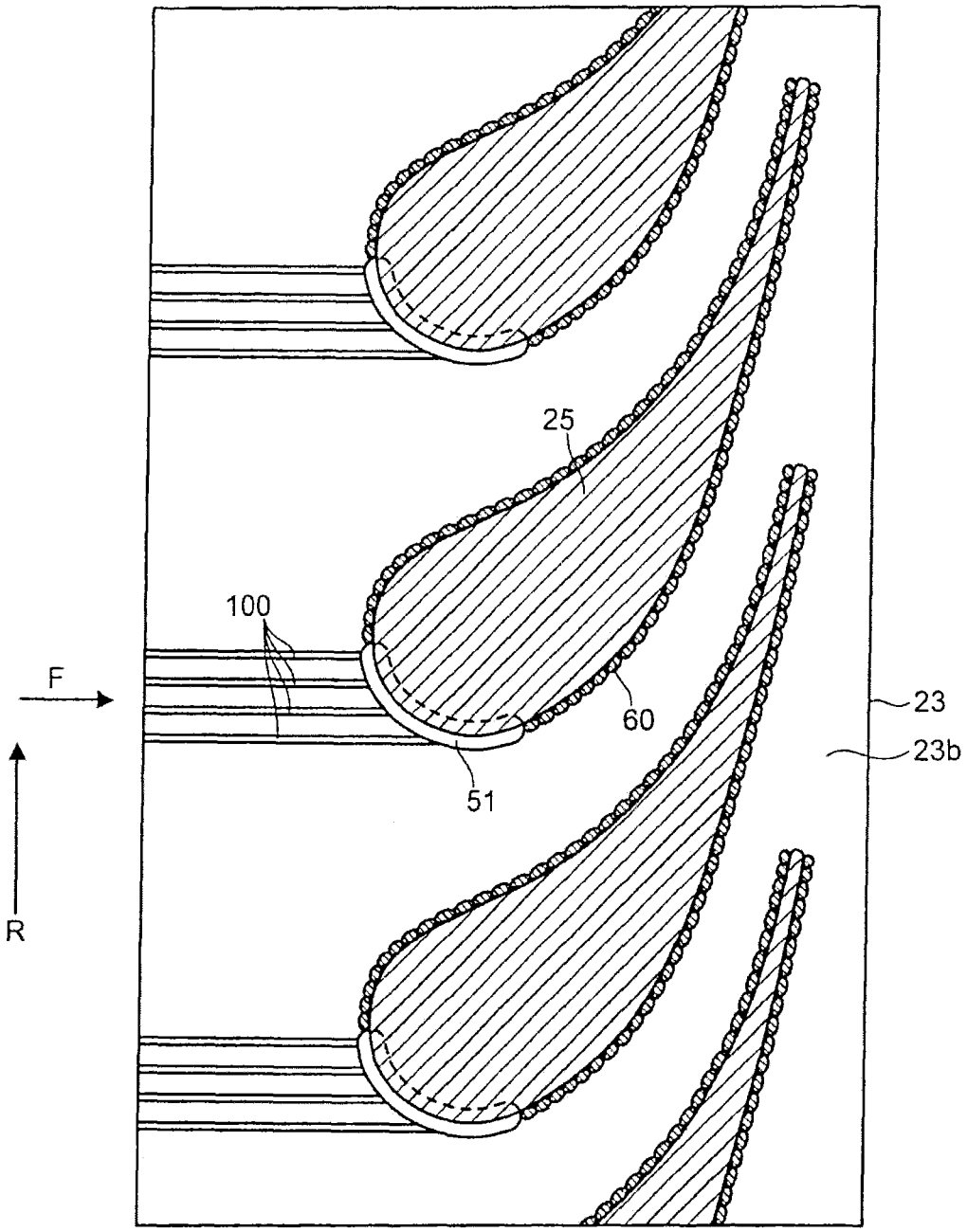
FIG. 13 is a view illustrating a cross section corresponding to the A-A cross section in FIG. 2 where a part of the final turbine stage in the steam turbine according to the third embodiment is illustrated.

FIG. 12 and FIG. 13 are views each illustrating a cross section corresponding to the A-A cross section in FIG. 2 where a part of a final turbine stage in a steam turbine 12 according to a third embodiment is illustrated. Here, the configuration of the suction part 40 of the steam turbine 10 according to the first embodiment illustrated in FIG. 1 is exemplified to be described. In FIG. 12, a rotational direction (arrow R) of the rotor blade and a flow direction (arrow F) of the steam are illustrated.

As illustrated in FIG. 12 and FIG. 13, guide grooves 100 guiding the water film to the suction port 51 are formed at the inner wall surface 23*b* of the diaphragm outer ring 23 in the steam turbine 12 according to the third embodiment. The guide groove 100 is continuously formed from, for example, an edge at an upstream side of the diaphragm outer ring 23 to the suction port 51. The guide grooves 100 may be formed in plural as illustrated in FIG. 12 and FIG. 13. Note that the effect acquired by having the guide groove 100 can be showed by having at least one guide groove 100.

The guide grooves 100 are formed, for example, in a direction in which the rotational direction of the rotor blade and the flow direction of the steam are combined as illustrated in FIG. 12. In addition, the guide grooves 100 may be formed, for example, in the flow direction of the steam as illustrated in FIG. 13. Note that the direction where the guide grooves 100 are formed is not limited thereto, but it can be arbitrary set. The guide grooves 100 can be formed easily by, for example, the cutting such as the end milling.

The guide grooves 100 are provided as stated above, and thereby, it is possible to precisely guide the water film adhered on the inner wall surface 23*b* of the diaphragm outer ring 23 to the suction port 51. It is thereby possible to effectively collect the water film adhered on the inner wall surface 23*b* of the diaphragm outer ring 23.

Here, the guide groove 100 is able to be applied to a steam turbine according to the other embodiments without being limited to the steam turbine 10 according to the first embodiment illustrated in FIG. 1.

According to the above-described embodiments, it is possible to easily form the suction part collecting the waterdroplet and the water film generated in the turbine even in a case when the thickness of the component increases.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine, comprising:

a casing where a turbine rotor is provided to penetrate;

a diaphragm outer ring arranged at an inner side of the casing, and having a hollow part inside thereof, an inner wall surface of the diaphragm outer ring forming a steam flow passage, the inner wall surface configured to move a water film toward a downstream of the steam flow passage while adhering the water film on the inner wall surface;

a diaphragm inner ring arranged at an inner side of the diaphragm outer ring;

a stationary blade forming a turbine stage with a rotor blade implanted in the turbine rotor and supported between the diaphragm outer ring and the diaphragm inner ring, the stationary blade having an end face at an outer diameter side, the end face being contacted with the inner wall surface of the diaphragm outer ring, the end face at the outer diameter side of the stationary blade being welded directly to the inner wall surface of the diaphragm outer ring;

a non-joint part existing (1) at a part of a joint part between the inner wall surface of the diaphragm outer ring and the end face at the outer diameter side of the stationary blade at the turbine stage where wet steam flows, and (2) at a leading edge portion of the stationary blade, and in which the end face at the outer diameter side of the stationary blade is not welded to the inner wall surface of the diaphragm outer ring; and a suction part communicated with the hollow part, and configured to collect waterdroplet or a water film from the non-joint part.

2. The steam turbine according to claim 1, wherein the suction part includes:

a through hole formed at an inner wall of the diaphragm outer ring, and communicating between a steam flow passage where main steam flows and the hollow part; and a suction port made up by the through hole which is not covered with the stationary blade when the stationary blade is joined to cover a part of the through hole at an inner wall surface of the diaphragm outer ring, wherein the non-joint part is the end face at the outer diameter side of the stationary blade covering a part of the through hole.

3. The steam turbine according to claim 1, wherein the suction part includes:

a through hole formed at an inner wall of a part where an inner wall surface is covered with the stationary blade when the stationary blade is joined, and communicated with the hollow part; and a suction port formed at an end face at the outer diameter side of the stationary blade and made up by a recessed groove communicated with the through hole, wherein the non-joint part is the end face at the outer diameter side of the stationary blade where the recessed groove is formed.

4. The steam turbine according to claim 2, wherein the suction port is made up of one or plural opening(s).

5. The steam turbine according to claim 3, wherein the suction port is made up of one or plural opening(s).

6. The steam turbine according to claim 2, wherein a guide groove guiding the water film to the suction port is formed at the inner wall surface of the diaphragm outer ring.

7. The steam turbine according to claim 3, wherein a guide groove guiding the water film to the suction port is formed at the inner wall surface of the diaphragm outer ring.

8. The steam turbine according to claim 4, wherein a guide groove guiding the water film to the suction port is formed at the inner wall surface of the diaphragm outer ring.

9. The steam turbine according to claim 5, wherein a guide groove guiding the water film to the suction port is formed at the inner wall surface of the diaphragm outer ring.

10. The steam turbine according to claim 1, wherein the hollow part is communicated with a condenser provided at outside of the steam turbine.

11. The steam turbine according to claim 2, wherein the hollow part is communicated with a condenser provided at outside of the steam turbine.

12. The steam turbine according to claim 3, wherein the hollow part is communicated with a condenser provided at outside of the steam turbine.

13. The steam turbine according to claim 4, wherein the hollow part is communicated with a condenser provided at outside of the steam turbine.

14. The steam turbine according to claim 5, wherein the hollow part is communicated with a condenser provided at outside of the steam turbine.

15. The steam turbine according to claim 6, wherein the hollow part is communicated with a condenser provided at outside of the steam turbine.

16. The steam turbine according to claim 7, wherein the hollow part is communicated with a condenser provided at outside of the steam turbine.

17. The steam turbine according to claim 8, wherein the hollow part is communicated with a condenser provided at outside of the steam turbine.

18. The steam turbine according to claim 9, wherein the hollow part is communicated with a condenser provided at outside of the steam turbine.

* * * * *